United States Patent [19]

Mino et al.

[11] 4,213,574

[45] Jul. 22, 1980

[54] GROOVED TRAVERSE DRUM USED IN DRUM WINDER

[75] Inventors: Masao Mino; Takeshi Ohno, both of Yao, Japan

[73] Assignee: Kabushiki Kaisha Mino Seisakusho, Osaka, Japan

[21] Appl. No.: 899,721

[22] Filed: Apr. 25, 1978

[51] Int. Cl.[2] ..... B65H 54/48
[52] U.S. Cl. ..... 242/43.2
[58] Field of Search ..... 242/43.2, 18 DD

[56] References Cited

U.S. PATENT DOCUMENTS

| | | | |
|---|---|---|---|
| 3,572,598 | 3/1971 | Chavis | 242/43.2 |
| 3,695,522 | 10/1972 | Pesch et al. | 242/43.2 |

*Primary Examiner*—Stanley N. Gilreath
*Attorney, Agent, or Firm*—Hall & Houghton

[57] ABSTRACT

A new and improved grooved traverse drum for winding yarn into a cone cheese is provided which is characterized by having the traverse drum end adjacent the small end of the cone cheese being of a reduced diameter for a major proportion of its circumference so as to eliminate slippage therebetween and thereby minimize possible yarn damage.

2 Claims, 2 Drawing Figures

GROOVED TRAVERSE DRUM USED IN DRUM WINDER

BACKGROUND OF THE INVENTION (a) Field of the Invention

The present invention relates to a grooved traverse drum used in a drum winder for winding a yarn into a cone cheese, especially having a large cone angle.

(b) Description of the Prior Art

Heretofore, when a yarn, especially one which is subject to damage due to the transmission of heat, such as synthetic fiber yarn, is wound into a cone cheese on a taper tube contacted with and rotated by the peripheral surface of a grooved traverse drum (hereinafter referred to simply as a drum), damage, such as yarn breakage, often occurs at the small-diameter end of the cheese. More specifically, when the cone cheese is rotated by the drum surface, the position at which the cone cheese is rotated by the drum is a position displaced from the center of the cone cheese toward the large-diameter side thereof. As a result, it is only at said position that the cone cheese can be rotated at a peripheral speed substantially equal to that of the drum at said position. Thus, at the small-diameter end farthest from said position, the considerable difference in peripheral speed causes a large amount of slippage in the direction of rotation. Therefore, the actual state is that the heat of friction due to said slippage causes damage to the yarn including yarn breakage. This tendency becomes the stronger, the greater the cone angle of the cheese. The damage, such as yarn breakage, has interfered with the subsequent unwinding of the cone cheese.

To overcome these difficulties, various proposals have been made but no satisfactory results have been obtained.

SUMMARY OF THE INVENTION

In view of the above drawbacks inherent in the prior art, the present invention is directed to the elimination of the aforementioned drawbacks by providing a grooved traverse drum of a construction capable of effectively preventing damage to the yarn at the small-diameter end of the cone cheese formed on the drum The improved construction of the traverse drum forming the basis of the present invention is based on the following consideration.

It is to be noted that it is only a small portion of the small-diameter end of the cone cheese rotated by the traverse drum that damage to the yarn occurs. Such damage occurs due to slippage friction between the traverse drum and the cone cheese. With this fact in mind, on the end of the drum opposed to the small-diameter end of the cone cheese, in a region which occupies the marginal drum surface bounded by the portions of the traverse groove running in the reverse directions from the return point adjacent the small-diameter end of the cone cheese to the first intersection, a portion of the drum surface, which in prior use was contacted with the yarn layer adjacent the small-diameter of the cone cheese, is made somewhat smaller in diameter than the rest of the drum surface which serves as the contact support surface for the cone cheese, whereby the friction between the drum and the cheese which occurs at this place is minimized. Further, in the above arrangement, in order to eliminate the vibration of the cheese due to the repetition of contact and non-contact between the peripheral surface of the small-diameter portion of the cheese and the cheese supporting surface of the drum, and to form a problem-free wound yarn layer, the boundary between said periphery surface of said somewhat smaller-diameter portion connects through a gentle slope with said cheese supporting surface.

DESCRIPTION OF THE PREFERRED EMBODIMENT

Figure 1:
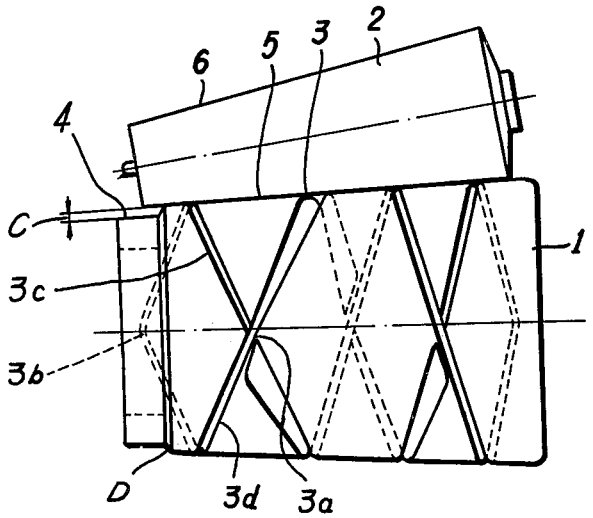
FIG. 1 is a side view illustrating a groove traverse drum made in accordance with the present invention and a cone cheese supported by and in operational association with the drum.

Referring to FIG. 1, the numeral 1 designates a grooved traverse drum; 2 designates a cone cheese placed on the drum to be rotated by the peripheral contact therewith; and 3 designates a traverse groove provided in the peripheral surface of the drum for guiding the yarn.

A peripheral end portion 4 at the end of the drum 1 and which is in opposed relationship to the small-diameter portion of the cone cheese being conically wound is somewhat smaller in diameter for a major proportion of its circumference than the remaining peripheral portion 5 of the drum 1, so that a clearance C is defined between the peripheral end portion 4 for a major proportion of its circumference and the peripheral surface of the cone cheese 2 at the small end thereof.

The peripheral end portion 4 includes the first reverse portion or turn **3*b* of the traverse groove 3 at a position displaced toward the small-diameter end of the cone cheese 2 and is formed as a portion of the peripheral surface on the end of the drum which is defined by and surrounded with groove portions 3*c* and 3*d* branching from the first intersection 3*a* and meeting each other at the turn 3*b* and which is contacted with the yarn layer adjacent the small-diameter end 6 of the cone cheese 2. More particularly, the recessed peripheral portion 4 is formed as an end portion of the peripheral surface of the drum on the end side where the area occupied by the peripheral surface portion 4 is annularly surrounded with the two groove portions 3*c* and 3*d*, the boundary line of said portion 4 being such that the region of the drum contacted with the yarn layer adjacent the small-diameter end 6 of the cheese 2, leaving the peripheral portion 3*e* of the turn 3*b*, has an axial length E and a circumferential length F. Therefore, the axial length E of said peripheral portion 4 is constant on the circumference and the circumferential length F is also constant in the axial direction. Therefore, the contact between the peripheral surface of the cone cheese 2 adjacent the small-diameter end 6 and the peripheral surface of the drum 1 becomes discontinuous, thereby minimizing the slip friction acting on peripheral surface of the cone cheese 2 in this portion, with no damage, such as yarn breakage, caused to the yarn, and making it possible to wind the yarn into a cone cheese having layers of wound yarn with neat cone ends. Further, by making the circumferential length F of the occupied region of the peripheral portion 4 longer than the axial length E, the area of the portion of the cheese adjacent the small-diameter end 6** where the yarn layer does not come in contact with the peripheral surface of the drum is increased, so that the slip friction can be further decreased and the damage, such as yarn breakage, can be prevented.

Figure 2:
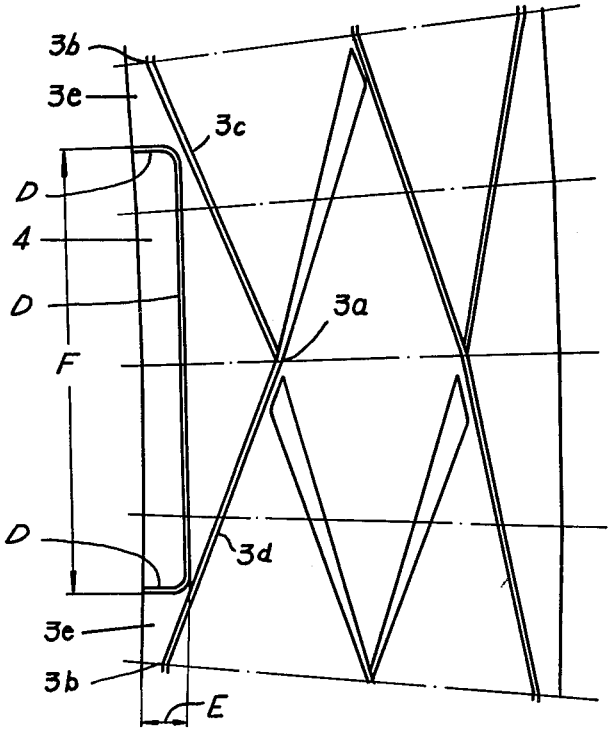
FIG. 2 is an enlarged developed view of the groove of the drum shown in FIG. 1.

In order to make reliable the guidance of the yarn at the turn 3*b*, the depth of the groove could be increased. However, deepening the groove requires additional time in producing the drum 1. According to the invention, the peripheral surface portion 4 somewhat smaller in diameter than the sheese supporting surface 5 is formed by leaving the peripheral portion 3*e* of the turn 3*b*, as shown in FIG. 2, whereby when the yarn is guided through the turn 3*b*, the yarn is prevented from being disengaged from the groove or being guided in an undesirable direction.

Further, in the case of the drum 1, the repetition of contact and non-contact between the peripheral surface of the cheese at the small-diameter end 6 and the cheese supporting surface 5 of the drum 1 causes the vibration of the cheese 2, raising a problem in forming neat yarn layers. According to the invention, the boundary region between the recessed peripheral surface portion 4 and the cheese supporting surface 5 is in the form of a gentle slope D, thereby preventing the vibration of the cheese 2 to form a problem-free wound yarn layers.

In addition, the results of the invention may be likewise obtained for any forms of drum.

As has been described so far, the invention provides a grooved traverse drum used in a drum winder for winding a yarn into a cone cheese, especially having a large cone angle, said drum being characterized in that on the end of the drum opposed to the small-diameter end of the cone cheese, in a region which occupies the marginal drum surface bounded by the portions of the traverse groove running in the reverse directions from the return point adjacent the small-diameter end of the cone cheese to the first intersection, a portion of the drum surface, which in prior use was contacted with the yarn layer adjacent the small-diameter end of cone cheese, is made somewhat smaller in diameter than the rest of the drum surface which serves as the support surface for the cone cheese, the boundary region being in the form of a gentle slope. As a result of this arrangement, the slip friction between the cheese and the drum acting on the portion of the peripheral recessed surface of the cheese adjacent the small-diameter end thereof can be minimized, preventing damage, such as yarn breakage, from being caused to the yarn, thus making it possible to wind the yarn into a cone cheese having layers of yarn with neat cone ends. Further, the fact that the non-gap surface 3*e* of the recessed drum end is continuous with the peripheral surface 5 of the main drum portion avoids the scuffing of the yarn layer adjacent the small diameter end of the cone cheese which would occur if localized protuberances were present on the surface of the drum that moved at a peripheral speed different from that of said small-diameter end. Also from the standpoint of construction, a conventional drum may be slightly modified, this being additional merit which is practically useful.

While specific embodiment of the invention has been described in detail with reference to the accompanying drawings, it is to be understood that the invention is not limited thereto and that various changes and modifications may be made by those skilled in the art without departing from the spirit and scope of the invention.

What is claimed is:

1. A grooved traverse drum for use in the winding of yarn into a cone cheese having a large axially extending cone angle thereby forming a large end portion and a small end portion at the opposite ends thereof, said drum including a main, axially extending drum portion having a drum surface which will function as the support for the cone cheese, said main drum portion extending axially substantially the full length of a cone cheese supported thereby, a drum end portion integrally formed with said main drum portion at the end thereof that will be in engagement with the small end portion of the cone cheese, a major portion of the circumferential surface of said drum end portion having a diameter less than the diameter of the main drum portion thereby forming a gap for a major circumferential distance between the surface of the drum end portion and the surface of the small end portion of the cone cheese, and at least two reversely directed, spirally arranged, intersecting traversing grooves in the surface of the main body portion of said drum, with a reversing portion of said traversing groove formed in the non-gap surface of the drum end portion of said drum, which non-gap surface of said end portion of said drum is continuous and even with the surface of said main drum portion, the circumferential surface of said main drum portion being continuous throughout the length thereof except for said grooves therein so as to provide continuous support along substantially the entire length of said cone cheese.

2. A grooved traverse drum in accordance with claim 1, wherein the yarn layer contacting surface of said main drum portion and of said non-gap portion continuous therewith are sloped inwardly toward the end of said drum at said drum end portion.

* * * * *